US005570473A

United States Patent [19]

Andries

[11] Patent Number: 5,570,473

[45] Date of Patent: Nov. 5, 1996

[54] CADDY HAVING A HANGER MEANS AND INTEGRAL TO A JACKET FOR SELECTIVELY SUPPORTING COMPANION PANTS FOR STORAGE AND ACCESS

[76] Inventor: Kenneth C. Andries, 19330 Southview La., New Berlin, Wis. 53146

[21] Appl. No.: 409,645

[22] Filed: Mar. 24, 1995

[51] Int. Cl.[6] ..... A41D 3/02

[52] U.S. Cl. ..... 2/93; 2/94; 2/108; 2/247

[58] Field of Search ..... 2/93, 85, 108, 2/115, 106, 94, 69, 69.5, 80, 79, 247, 249, 250, 251, 94

[56] References Cited

U.S. PATENT DOCUMENTS

| | | | |
|---|---|---|---|
| 1,723,214 | 8/1929 | Smith . | |
| 2,865,025 | 12/1958 | Hennessey | 2/94 |
| 2,873,449 | 2/1959 | Herbert | 2/94 |
| 3,046,563 | 7/1962 | Coleman . | |
| 3,246,343 | 4/1966 | Gilligan | 2/250 |
| 4,470,155 | 9/1984 | Maeshima | 2/108 |
| 4,700,409 | 10/1987 | De Lott | 2/94 |
| 5,040,243 | 8/1991 | Tatsuno . | |
| 5,123,117 | 6/1992 | Predergast . | |

FOREIGN PATENT DOCUMENTS

| | | |
|---|---|---|
| 637780 | 11/1936 | Germany . |
| 2208503 | 8/1973 | Germany . |

*Primary Examiner*—C. D. Crowder
*Assistant Examiner*—Gloria Hale

[57] ABSTRACT

A caddy integral to a jacket or other upper garment is provided for conveniently storing and accessing companion pants or other lower garment. A panel formed of mesh net or other porous fabric or other material is joined to an inner surface of the upper garment to form a compartment for receiving the lower garment, the compartment being sized to evenly distribute the bulk of the lower garment over a substantial portion of the inner surface of the upper garment. A hanger device is provided in the compartment for supporting the lower garment within the compartment while the upper garment is being worn. The compartment is constructed to allow access to the compartment from the inside of the upper garment to permit a wearer to quickly and easily remove the lower garment from the compartment, without removal of the upper garment.

18 Claims, 2 Drawing Sheets

CADDY HAVING A HANGER MEANS AND INTEGRAL TO A JACKET FOR SELECTIVELY SUPPORTING COMPANION PANTS FOR STORAGE AND ACCESS

BACKGROUND OF THE INVENTION

The invention disclosed and claimed herein is generally directed to means provided in an upper garment for conveniently storing a companion lower garment. More particularly, the invention pertains to storage means of such type which minimizes interference with a wearer of the upper garment, and permits the wearer to quickly and easily access the lower garment from storage while the upper garment is being worn.

A wide variety of outdoor clothing is currently sold in the form of matched or companion jacket and panes sets. Some common examples of such clothing, which are by no means intended to be inclusive, are rain gear for hunters, fisherman, and boaters, and warm-up suits for joggers. Spectators and participants in outdoor sports events also find this type of clothing to be very useful.

Notwithstanding the wide diversity found in matched set clothing of the above type, with regards to use, style and material, wearers thereof frequently encounter a common problem. Specifically, conditions of use can vary substantially over the course of a single period of activity. If so, wearers of such clothing will likely want to wear both the jacket and the pants during a portion of the activity period, but the jacket only during another portion thereof. For example, a jogger may start out wearing both a warm-up jacket and pants, However, after a time of vigorous exercise, he or she may wish to remove the pants and wear the jacket only, but be at a location remote from his or her intended end point. The jogger will then be required to carry the pants in some manner, which may impede or interfere with further physical activity.

A further illustration of this problem relates to rain gear, such as may be worn by a hunter, fisherman or boating enthusiast. A period of activity may begin under circumstances which make it comfortable to wear a rain jacket, but not companion rain pants. At the same time, conditions may suggest the possibility of rain or the like before the period of activity concludes. Accordingly, the user would want to make sure that the rain pants were continually available. Moreover, if there was, for example, the prospect of a severe rain storm developing suddenly, the user would want to access the rain pants very quickly, and without any need to remove the protective rain jacket. In some situations, it would be important not only to access the rain pants very quickly, but to do so with only one hand. This requirement could be very important, for example, for one operating a power boat, who needed to have one hand continually available for boat control, while accessing the rain pants for use.

The prior art shows various pocket and pouch arrangements formed in jackets or other upper body garments. Some of such arrangements simply do not anticipate providing enough storage capacity for an object on the size of pants or the like. Other arrangements would not accommodate a pair of pants, unless the pants were bunched or compacted into a tight ball. The resulting bulkiness and concentration of weight could interfere with activities of the type described above, or could cause discomfort to the wearer. Moreover, the pants would be subjected to unnecessary stress and wear, whenever forced into the pocket or pouch. In any event, none of such prior art arrangements appear to meet all the requirements set forth above, particularly the requirements pertaining to ease and convenience in both storing and removing a lower body garment from a storage position integral to an associated upper body garment.

SUMMARY OF THE INVENTION

The invention is generally directed to a caddy for a garment set comprising upper and lower garments, the caddy being formed in the upper garment for selectively snoring, carrying and easily accessing the lower garment. The caddy generally comprises means joined to an inner surface of the upper garment, for forming a compartment therewith which is sized to receive the lower garment, and means within the compartment for selectively supporting the lower garment therein while the upper garment is being worn. The compartment forming means is constructed to selectively provide access to the compartment from the inside of the upper garment, and to permit the lower garment to be removed from the compartment by a wearer of the upper garment, while such garment is being worn.

In a preferred embodiment of the invention, the upper garment comprises a piece or panel of material which is sewn, riveted or otherwise joined to the back portion of the upper garment. The supporting means comprises means for releasably supporting the lower garment in the compartment, and is located proximate to the upper portion thereof. Preferably, the releasable supporting means comprises a hanger strap, such as a nylon cord, for suspending the lower garment to hang downwardly while the upper garment is being worn, in combination with means for fixably securing one end of the strap, relative to the upper garment, and for releasably securing the other end of the strap relative thereto. Preferably also, an aperture or opening is formed, either through the fabric panel or between the panel and the upper garment, which is proximate to the bottom portion of the compartment. Also, the compartment is sized to extend across most of the area of the inner surface of the back portion of the upper garment. Thus, the lower garment can be evenly distributed to minimize the bulk or thickness thereof while being stored and carried.

An object of the invention is to provide a caddy inside an upper garment, such as a jacket, for conveniently storing and accessing companion pants or other lower garment.

Another object is to provide a caddy of the above type wherein the lower garment is suspended to hang therein to prevent bunching of the lower garment, and to otherwise minimize the thickness and distribute the weight of a lower garment while stored therein.

Another object is to provide a caddy of the above type, wherein a support member carrying the weight of the lower garment is positioned proximate to the shoulders of a wearer of the upper garment.

Another object is to enable a wearer of the upper garment to quickly and easily remove the lower garment from the caddy, using only one hand if necessary, without removal of the upper garment.

Another object is to provide a convenient storage arrangement to keep matching pants and jacket together when the pants are not being worn.

These and other objects of the invention will become more readily apparent from the ensuing specification, taken together with the drawings.

DETAILED DESCRIPTION OF THE PREFERRED EMBODIMENT

Figures 1, 2, 5:
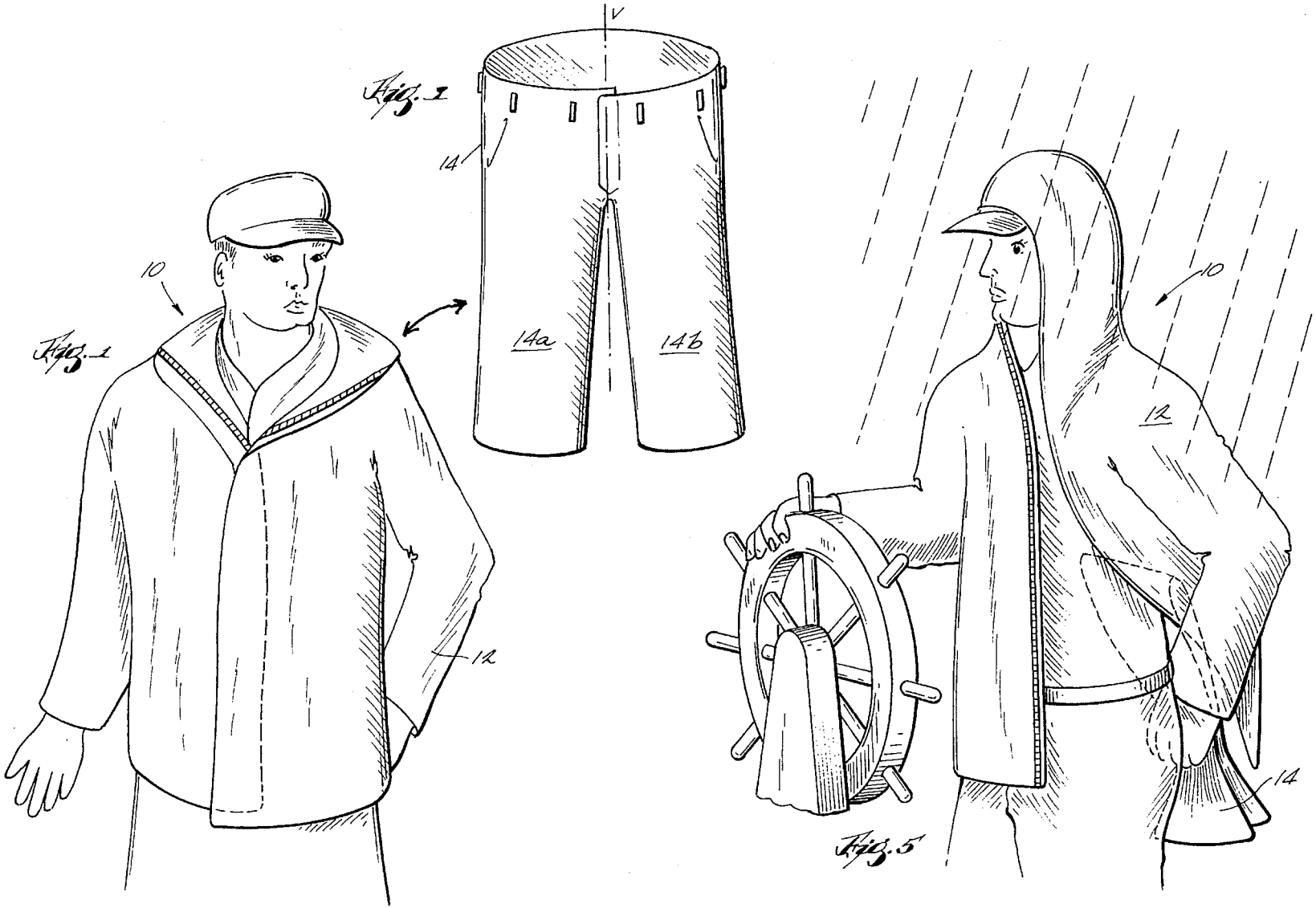
FIG. 1 is a perspective view showing a wearer of a jacket provided with an embodiment of the invention, and further shows an accompanying pair of pants.
FIG. 2 is a perspective view showing an embodiment of the invention.
FIG. 5 is a perspective view showing removal of the lower garment from the embodiment of FIG. 2.

Referring to FIG. 1, there is shown a wearer 10 of a jacket 12, which forms a matched or companion garment set with pants or trousers 14. Jacket 12 and pants 14 may together comprise rain gear, a warm up suit for outdoor athletic activity, or other clothing. Usefully, jacket 12 and pants 14 are formed of a material which is light and thin, such as plastic, nylon or dacron polyester. However, the invention is not limited thereto, or to any particular use or uses.

FIG. 1 further shows pants 14 divided into symmetrical components 14*a* and 14*b* by a hypothetical axis V. Pants 14 may be folded about hypothetical axis V so that one of the components overlays the other, as shown in FIG. 2. FIG. 2 further shows pants 14 also folded about a hypothetical axis H, so that the bottoms of components 14*a* and 14*b* lay substantially even with the waistband of the pants 14.

Referring further to FIG. 2, there is shown a piece or panel of material 16, preferably formed of net mesh or loosely woven fabric, joined to the inner surface of the back portion 12*a* of jacket 12. Usefully, a panel 16 is of generally rectangular shape, and all four of its edges are sewn to the back portion 12*a* of jacket 12, by means of thread 18. Cloth, plastic or other materials could alternatively be used for panel 16.

Figures 2, 3, 4, 6:
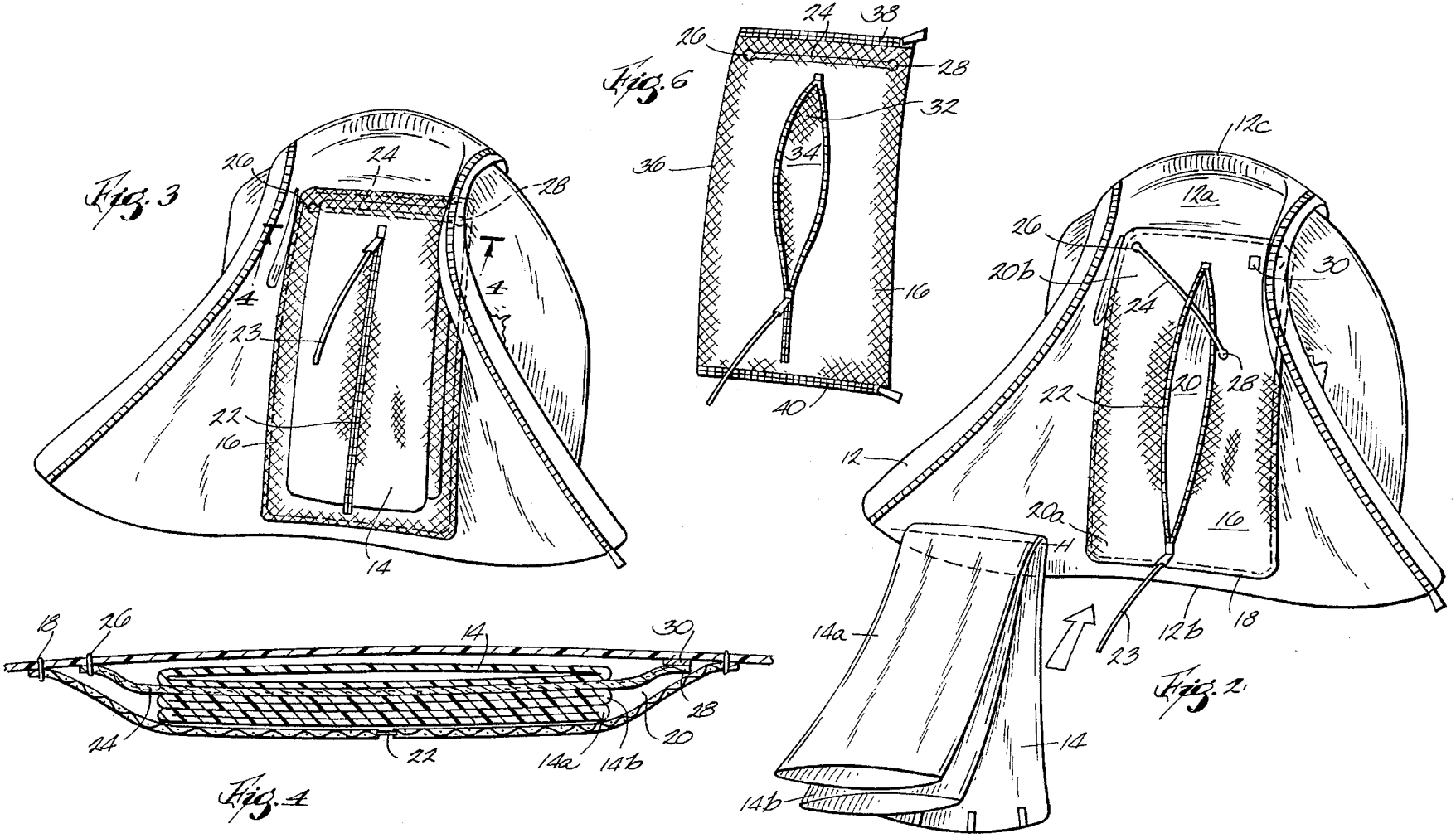
FIG. 3 is a perspective view showing the embodiment of FIG. 2 in use.
FIG. 4 is a sectional view taken through lines 4—4 of FIG. 3.
FIG. 6 is a perspective view showing a modification of the invention, wherein such modification is selectively removable from the jacket to provide an independent storage container for the pants.

The dimensions of panel 16 are selected so as to be slightly larger than the area of pants 14, when lying flat after folding as shown in FIG. 2. At the same time, panel 16 may be drawn away from jacket 12 to form a space or compartment 20 between the jacket 12 and the panel 16, as best shown in FIG. 4. Such compartment is sized to receive pants 14 when folded and flattened as described above. FIG. 2 further shows an aperture or opening provided through panel 16, a zipper 22 being provided around the aperture to selectively open and close compartment 20. A draw string or thin cord 23 is usefully attached to hang downwardly from the zipper. Zipper 22 is preferably moved downwardly, as shown in FIG. 2, i.e., toward lower edge 12*b* of jacket 12 and away from the upper edge 12*c* thereof, to open the compartment 20. It is anticipated that such downward motion will normally be the easiest and quickest motion to perform, to gain access to compartment 20 while jacket 12 is being worn. It will also be seen from FIG. 2 that the aperture through panel 16 extends downwardly, to the lower portion 20*a* of compartment 20, which is proximate to the lower edge 12*b* of jacket 12.

Referring further to FIG. 2, there is shown a hanger strap 24, usefully comprising a braided nylon cord. One end of the cord is fixably secured to jacket 12, at the upper portion 20*b* of compartment 20, by means of an attachment element 26, which may be a rivet, thread or other means well known in the art. An attachment element 28 is also joined to the other end of strap 24, to selectively join to and detach from a corresponding attachment element 30, fixed to jacket 12. Thus, such end of strap 24 can be joined to jacket 12 or separated therefrom by slight pressure. Elements 28 and 30 likewise comprise means well known in the art. For example, they may respectively comprise the two components of a releasable attachment system sold under the trademark VELCRO. Alternatively, they may respectively comprise male and female snap components.

By providing zipper 22, as well as a hanger strap 24 having one releasably attachable end, it is very convenient to place pants 14 in compartment 20, in their folded condition, the pants being folded over hanger strap 24 along hypothetical axis H.

It is also anticipated, depending on the space available when pants 14 are contained in compartment 20, that the lower portion of the compartment could additionally provide storage for small items such as gloves or the like.

Referring to FIGS. 3 and 4 together, there is shown pants 14 suspended from hanger strap 24 within compartment 20, attachment elements 28 and 30 being in engagement. The material of the pants is thus distributed over most of the back of jacket 12, to minimize the thickness or bulk of the pants at any given location of jacket 12. Also, the weight of the pants 14 is transferred through hanger strap 24 to the shoulders of jacket 12, and there through to the shoulders of a wearer. Any hinderance to the wearer due to the weight or bulk of the pants Is thereby minimized.

By forming panel 16 from mesh or other porous or breathable cloth material, pants 14 contained in compartment 20 may be ventilated. The material chosen for fabric 16 may also be provided with some degree of stretchability, so as to hold pants 14 evenly and compactly against jacket 12.

FIG. 5 illustrates removal of the pants from compartment 20 of jacket 12, while the jacket is being worn, such as to maintain protection against rain or other inclement weather. Generally, with one hand the wearer 10 can reach up behind the inside of his jacket, grasp the draw string 23 to draw down the zipper 22, and apply a comparatively slight pull to the pants. Releasable attachment elements 28 and 30 are designed to uncouple from one another in response to such pressure, as stated above, immediately releasing the pants and allowing them to slide off the strap 24 to become available for use by wearer 10. Preferably, the pants are pulled on the side thereof proximate to the releasable elements, 28 and 30, to most effectively disengage elements 28 and 30. It is to be understood that the other hand of the wearer could, if necessary, be involved in a completely unrelated task while the pants were being removed from compartment 20.

In a modification of the invention, either attachment element 26 or 30, or both of them, may be fixably secured to the panel 16, rather than to the jacket 12.

In a further modification, panel 16 may be joined to jacket 12 by means of rivets positioned at the upper corners of panel 16, and snaps positioned at the lower corners thereof. The pants 14 would be placed into compartment 20 by unfastening the snaps and lifting the panel from its lower edge, as viewed in FIG. 2. Pants 14 could be accessed by reaching upwardly, between the jacket 12 and the lower edge of the panel 16. Such modification would eliminate the need for zipper 22 and an aperture through panel 16.

Referring to FIG. 6, there is shown another modification of the invention wherein the panel 16, instead of being directly joined to the back of jacket 12 as described above, is joined to a panel of material 32. Preferably, panel 32 is formed of the same net mesh or other material as panel 16, and is of substantially the same shape and dimensions thereof. Panels 16 and 32 are joined together along their respective common edges, by any suitable means, so that a space 34 is provided therebetween which is sized to receive pants 14, when folded as described above and shown in FIG. 2. Panels 16 and 32 thus together form a caddy 36 for pants 14. As described above, caddy 36 is likewise provided with a hanger strap 24, together with attachment elements 26, 28 and 30. Attachment elements 26 and 30 are fixably joined to panel 36 by any conventional means.

FIG. 6 further shows zipper components 38 and 40 joined along the upper and lower edges, respectively, of caddy 36, as viewed in FIG. 6. Other zipper components (not shown), which are respectively complementary to components 38 and 40 so that components 38 and 40 can removably mate therewith, are attached to the inner surface of the back portion of jacket 12. Thus, caddy 36 can be selectively joined thereto and removed therefrom by means of the zipper components 38 and 40. It is intended that caddy 36, when joined to jacket 12, will be positioned similarly thereto as panel 16, as shown in FIG. 2.

By providing a caddy 36 which is removable from jacket 12, the entire structure for storing the pants 14 may be separated from the jacket. This may be desirable, for example, when the jacket is to be used under circumstances such that the pants will not be needed. At the same time, the caddy 36 may be designed to hang in a closet, or to otherwise provide convenient storage for the pants, when detached from the jacket.

Obviously, many other modifications and variations of the present invention are possible in light of the above teachings. It is therefore to be understood that within the scope of the disclosed inventive concept, the invention may be practiced otherwise than as specifically described.

What is claimed is:

1. A caddy for use with an upper garment comprising a jacket provided with a back portion having an inner surface and a lower garment comprising pants, said caddy comprising:

means for forming a compartment sized to receive said lower garment, said compartment forming means comprising a panel of selected material and dimensions joined to said inner surface;

means within the said compartment for selectively supporting said lower garment therein while said upper garment is being worn; and said compartment forming means constructed to selectively provide access to said compartment from an interior space defined by said upper garment, to permit said lower garment to be removed from said compartment by a wearer of said upper garment.

2. The caddy of claim 1 wherein:

said upper garment has upper and lower edges, and said compartment has an upper portion oriented toward said upper edge and a lower portion oriented toward said lower edge; and said supporting means comprises means for releasably supporting said lower garment, and is located proximate to said upper portion of said compartment.

3. The caddy of claim 2 wherein said releasable supporting means comprises:

a hanger strap having first and second ends in opposing relationship for suspending said lower garment to hang downwardly while said upper garment is being worn;

means for fixably securing said first end of said strap with respect to said upper garment; and means for releasably securing said second end of said strap with respect to said upper garment.

4. The caddy of claim 2 wherein:

said compartment forming means is constructed to provide an opening proximate to a lower portion of said compartment.

5. The caddy of claim 2 wherein:

said panel comprises a panel of mesh net material selectively joined to said jacket.

6. The caddy of claim 2 wherein:

an aperture is formed through said panel to enable access to said compartment, said aperture generally extending between said upper and lower portions of said compartment; and a zipper is joined to said panel to selectively open and close said aperture, said zipper being pulled downwardly when said jacket is being worn to open said aperture and allow access to said compartment.

7. The caddy of claim 2 wherein:

an opening is provided between said material and said jacket to provide access to the lower portion of said compartment by a wearer of said jacket.

8. The caddy of claim 2 wherein:

said material is joined to said jacket to provide a compartment extending across most of the area of the inner surface of the back portion of said jacket.

9. The caddy of claim 1 wherein:

said compartment forming means comprises first and second panels of selected material of substantially the same dimensions, said first and second panels being selectively joined together along their respective common edges to form said compartment; and means are provided for detachably joining said compartment forming means to said inner surface of said upper garment.

10. In a garment set comprising pants and a jacket provided with a back portion having an inner surface, a storage arrangement integral to the jacket comprising:

a panel of selected material joined to said inner surface of the back portion of the jacket to form a compartment between said panel and said inner surface, said compartment being of sufficient dimensions to receive the pants in a folded condition, and to distribute the bulk thereof over most of the area of said inner surface of said back portion; and means for selectively suspending said pants within said compartment while said jacket is being worn.

11. The storage arrangement of claim 10 wherein:

said arrangement includes means for providing access to said compartment from an interior space defined by said jacket while said jacket is being worn.

12. The storage arrangement of claim 11 wherein:

said means for providing access comprises a zipper positioned to selectively close and open an aperture formed in said panel.

13. The storage arrangement of claim 10 wherein:

said suspending means includes means which are releasable to permit removal of said pants from said compartment.

14. The storage arrangement of claim 13 wherein said suspending means comprises:

a hanger strap having first and second ends in opposing relationship;

means for fixably securing said first end of said strap with respect to said jacket; and means for releasably securing said second end of said strap with respect to said jacket.

15. The storage arrangement of claim 10 wherein:

an opening into said compartment is provided proximate to a bottom portion thereof.

16. The storage arrangement of claim 10 wherein:

said panel is formed from material permitting said pants to be ventilated while stored in said compartment.

17. The storage arrangement of claim 16 wherein: said panel is formed from a mesh net material.

18. The storage arrangement of claim 10 wherein:

said suspending means comprises means for maintaining said distribution of said pants with respect to the said area of said inner surface while said jacket being worn.

* * * * *